US011801998B2

(12) United States Patent
McNeilus et al.

(10) Patent No.: US 11,801,998 B2
(45) Date of Patent: Oct. 31, 2023

(54) REFUSE COLLECTION VEHICLE HAVING BOLT-ON FENDERS

(71) Applicant: Con-Tech Manufacturing, Inc., Dodge Center, MN (US)

(72) Inventors: Grant McNeilus, Dodge Center, MN (US); Garwin McNeilus, Dodge Center, MN (US); Jay Attleson, Rochester, MN (US)

(73) Assignee: Con-Tech Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 17/146,377

(22) Filed: Jan. 11, 2021

(65) Prior Publication Data

US 2022/0219894 A1 Jul. 14, 2022

(51) Int. Cl.
*B65F 3/02* (2006.01)

(52) U.S. Cl.
CPC ..... *B65F 3/02* (2013.01); *B65F 2003/0263* (2013.01)

(58) Field of Classification Search
CPC ..... B65F 3/02; B65F 2003/0263; B60R 19/42
See application file for complete search history.

(56) References Cited

U.S. PATENT DOCUMENTS

| | | | | |
|---|---|---|---|---|
| 3,143,230 | A * | 8/1964 | Gollnick | B65F 3/207 414/525.4 |
| 3,765,555 | A * | 10/1973 | McKenzie | B65F 3/02 403/210 |
| 3,909,053 | A * | 9/1975 | Koch | B60R 19/42 293/126 |
| 5,271,658 | A | 12/1993 | Haldenwanger et al. | |
| 5,720,588 | A * | 2/1998 | Graves | B65F 3/02 414/421 |
| 6,179,354 | B1 * | 1/2001 | Bennett, Jr. | B60R 19/42 293/DIG. 6 |
| 6,431,605 | B1 | 8/2002 | Miller et al. | |
| 6,929,313 | B2 | 8/2005 | Fries et al. | |
| 9,371,094 | B1 | 6/2016 | Ferauche et al. | |
| 10,611,326 | B2 | 4/2020 | Mcneilus et al. | |
| 2007/0018466 | A1 * | 1/2007 | Hohendorn | B60R 19/24 293/155 |
| 2013/0193717 | A1 | 8/2013 | Rund et al. | |
| 2017/0259769 | A1 * | 9/2017 | Kurihara | B60R 19/56 |

* cited by examiner

*Primary Examiner* — Jonathan Snelting
(74) *Attorney, Agent, or Firm* — Craig J. Lervick; Larkin Hoffman Daly & Lindgren, Ltd.

(57) ABSTRACT

To provide additional flexibility for a refuse collection vehicle, a removable fender panels are used on an outside portion of the main collection body. The removable fender panels are formed to have a sloped section that will cause rain, snow and other materials to naturally drain from the panel, thus helping to maintain the appearance of the vehicle. Since the fender panels are removable, they can be easily replaced when excessive signs of wear begin to appear. Further, this provides further flexibility during the manufacturing process since the panels can be manufactured from a wide variety of materials including steel, stainless steel, aluminum and many non-metallic materials.

21 Claims, 4 Drawing Sheets

REFUSE COLLECTION VEHICLE HAVING BOLT-ON FENDERS

BACKGROUND

Heavy duty mechanical equipment used throughout the world typically includes a unique combination of work pieces, related power supplies and robust components specifically configured to withstand harsh operating environments. In many situations, this equipment includes specially designed mechanical components (i.e. levers, working surfaces, housings, shields, brackets, etc.) and related power actuators (e.g. hydraulic cylinders). In practice, the mechanical systems are all uniquely designed to carry out the desired motions/functions, meet the specific needs of the device, or provide appropriate protection.

As mentioned above, these heavy-duty systems often operate in harsh conditions. Some examples include earth-moving equipment, machines used in mining, garbage collection/hauling trucks, manufacturing systems, etc. Consequently, any efforts to provide additional durability and prolong the life of components is very beneficial.

One specific application where mechanical systems are used in such harsh conditions is the refuse truck. These trucks operate year-round in all types of conditions—extreme heat, extreme cold, rain, snow, etc. They also must travel all types of roads. When operating, it is important for refuse trucks (and virtually all trucks) to have fenders and related guards which prevent rocks and stones from being thrown. These fenders protect others on the roads, and portions of the vehicle itself. Fenders can take many forms, but generally surround and protect various areas around the truck wheels themselves. Typically, the fenders are positioned above the wheels and may extend part way down the front, back or sides. In some cases however, the configuration of the fender can create an unexpected concern. More specifically, rocks and debris can occasionally accumulate on a flat upper surface of the fender. If not removed, this debris can then be dropped or expelled from the truck while in motion. As would be recognized, this could potentially cause damage to other vehicles, and or other individuals.

In addition to the issues outlined above, damage to fenders is quite common. Again, fenders are specifically designed to contain spray and debris that may be propelled from the wheels. This could include significant rocks and other items that are capable of denting the fenders themselves. More specifically, a rock thrown from a tire into the underside of the fender will typically create a dent. Although the dent will not often prevent use of the truck, it will create paint peeling and unsightly damage which is undesirable. With standard metal fenders, repairing these dents and chipped paint is an involved and cumbersome task.

In light of these concerns and the harsh operating conditions encountered, it is desirable to have components of the refuse truck which can be durable and easily repaired. Further, it is beneficial to provide various operators with several options to best meet their particular needs.

SUMMARY

To provide a refuse truck with improved durability, flexibility and efficiency, an improved fender design for a refuse truck as described below. Further, several details are modified to improve the manufacturability, durability and flexibility.

BRIEF DESCRIPTION OF THE DRAWINGS

Further advantages of the systems, devices and embodiments for improved operations of a refuse truck will be better understood from reading the description set forth below in conjunction with the drawings, in which.

DESCRIPTION

Figure 1:
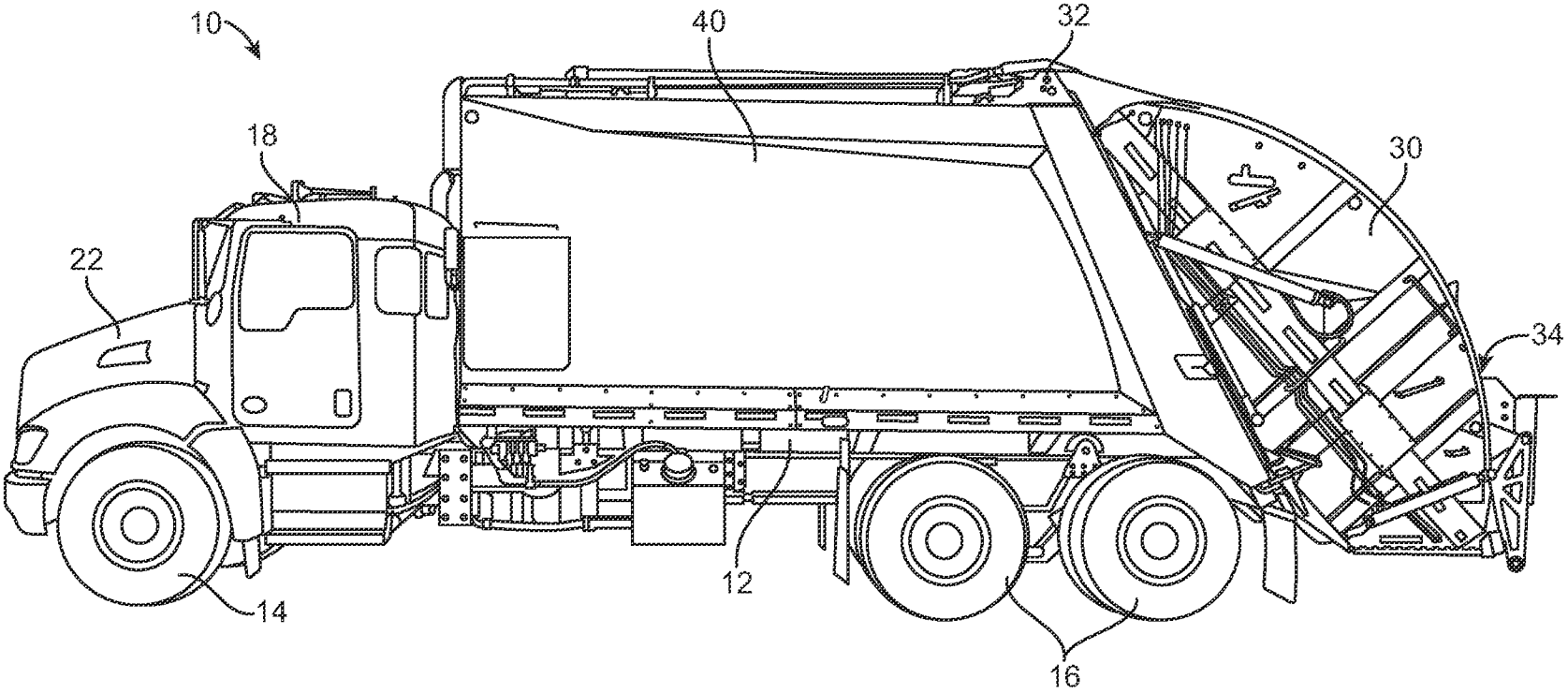
FIG. 1 is a perspective view of an exemplary refuse truck.

Existing refuse collection trucks generally come in one of many different configurations, including a front loader version, side loader version, and rear loader version. As the names suggest, variations in operation and layout drive the way these refuse vehicles operate. Turning now to FIG. 1, one example of a rear loader refuse truck is illustrated. In this embodiment, rear loader refuse truck 10 is shown having a truck frame 12 supported by a pair of front wheels 14, and a set of rear wheels 16. Frame 12 also supports a cab 18 designed to contain several operator controls. As will also be recognized, a motor or engine (not shown) is housed under a front hood 22 and is configured to supply necessary power. Further components which will be clearly understood but are not specifically illustrated include a transmission, hydraulic pumps, an electrical power supply, hydraulic power structures (tubes, valves, etc.), and other operating components. Those skilled in the art will recognize the need and general operation of these components.

Also illustrated in FIG. 1, frame 12 supports and carries a collection mechanism 30 and a main collection body 40 which is designed to define or create a main collection compartment 42. As is appreciated, collection mechanism 30 will include a bin, hopper or collection area 34 which is designed and configured to easily allow operators to deposit refuse therein. In operation, a sweep and scoop mechanism is used to pull refuse from the collection hopper 34 into main collection compartment 42. In addition, compaction equipment is included so refuse is compacted as collection operations occur, thereby more efficiently utilizing the space and main collection compartment 42. Further, it is typical for collection mechanism 30 to be hingeably mounted to main collection body 40 at an upper hinge point 32. Based upon this connection methodology, the collection mechanism 30 can be swung upward and out of the way, thus allowing main collection compartment 40 to be easily emptied when full.

Figure 2:
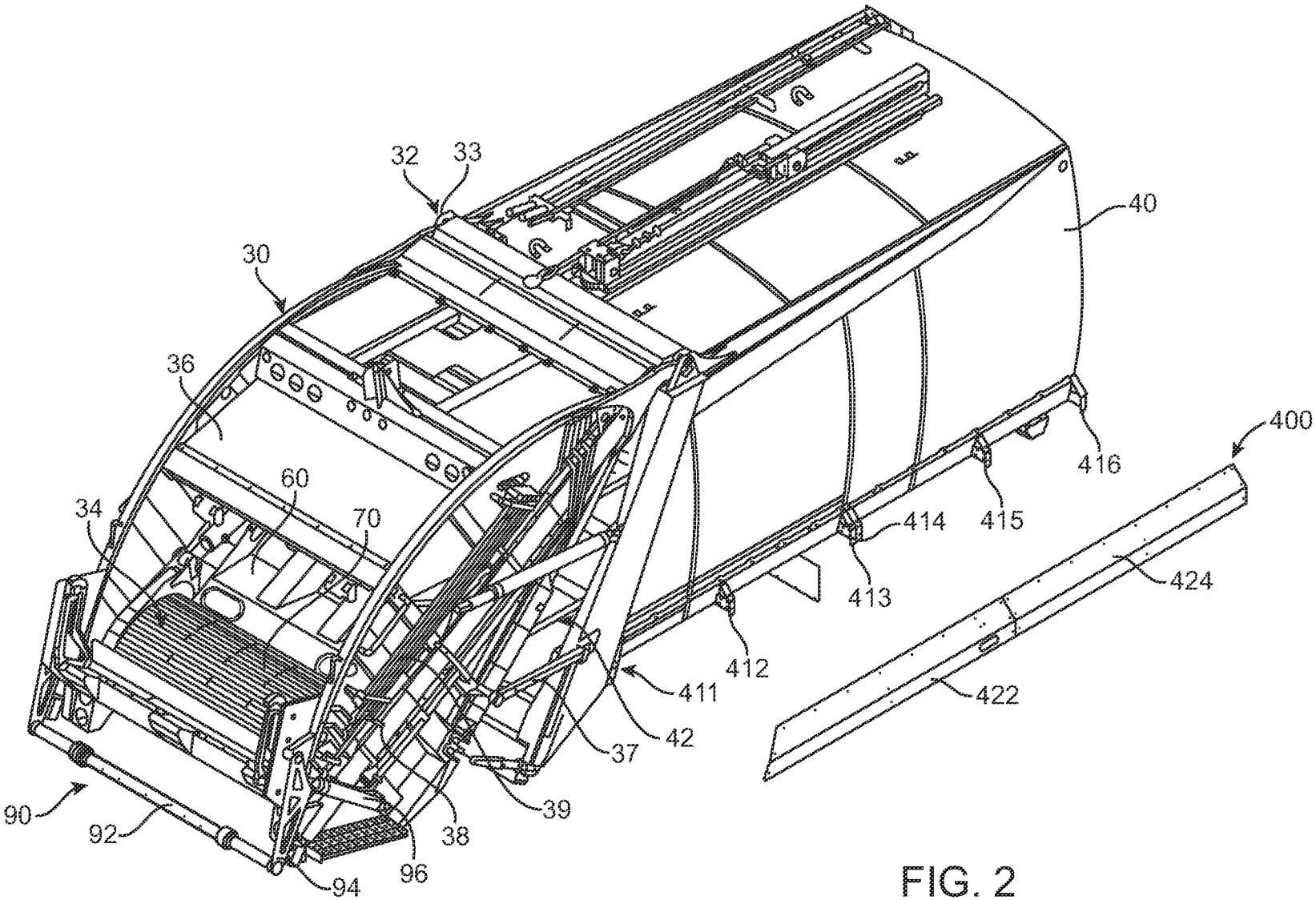
FIG. 2 shows certain details of the refuse collection systems of the exemplary refuse truck shown in FIG. 1.

As suggested above, collection mechanism 30 includes several components which are specifically designed and configured to accommodate the collection of refuse. As one example, FIG. 2 presents a perspective view of the collection mechanism 30 alone, which again is connected to main collection body 40 at hinge point 32 by a hinge connection 33. In FIG. 2, collection mechanism 30 is pulled away from main collection body 40 slightly, thus exposing a portion of main collection compartment 42. Here, collection mechanism 42 is held in place by a lockout bar 37. It is contemplated that the hinge connection 33 is achieved by appropriate hinge pins to accommodate the hinging of collection mechanism 30 as an entire unit.

Turning again to FIG. 2, refuse collection vehicle 10 includes a main collection chamber or compartment 40, which forms a large portion of refuse collection truck 10. As will be appreciated, fenders utilized along the side of main collection compartment 40 can provide protection and avoid eliminates or covers any flat/horizontal surfaces. Unfortunately, these fenders are easily worn or deteriorated, which is clearly undesirable. These fenders are clearly visible from the outside while collection vehicle 10 travels throughout the streets and creates a negative impression if these fenders are worn or unsightly.

To provide various alternatives and ease of maintenance, bolt-on fenders are specifically configured to be utilized in the various embodiments disclosed herein. In the embodiment illustrated in FIG. 2, main collection body 40 is configured to have a plurality of bracket assemblies 400 located on a lower portion thereof. In this embodiment, the plurality of bracket assemblies includes a first bracket 411, second bracket 412, third bracket 413, fourth bracket 414, fifth bracket 415 and sixth bracket 416. Bolt-on fender assembly 400 further also includes a first fender panel 422 and a second fender panel 424. In this configuration, the fender assembly 400 and specifically first panel 422 and second panel 424 can be easily removed and replaced at any time during the life of the refuse collection vehicle. Clearly, FIG. 2 shows only a first side of main collection body 40 and it will be understood that similar structure will exist on an opposite side. It is further contemplated that first fender panel 422 and second fender panel 424 could be formed of many different materials including composites, steel, metal, stainless steel, etc. In this manner, the life of the vehicle and the appearance can be easily adjusted, modified, and improved at any time.

Figure 3A:
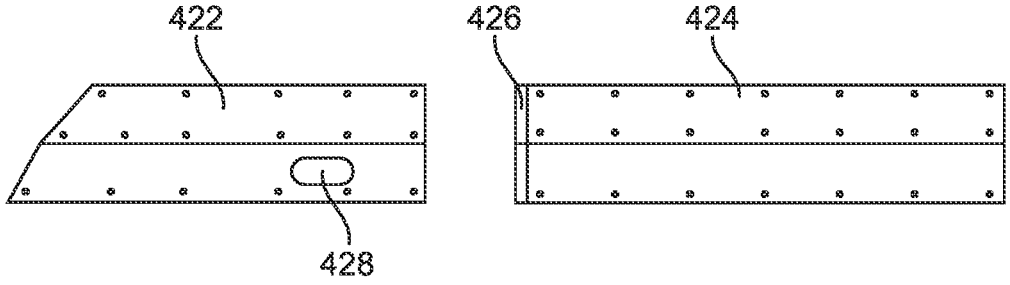
FIGS. 3A and 3B show front views of two alternative embodiments of the bolt-on fenders.
Figure 3B:
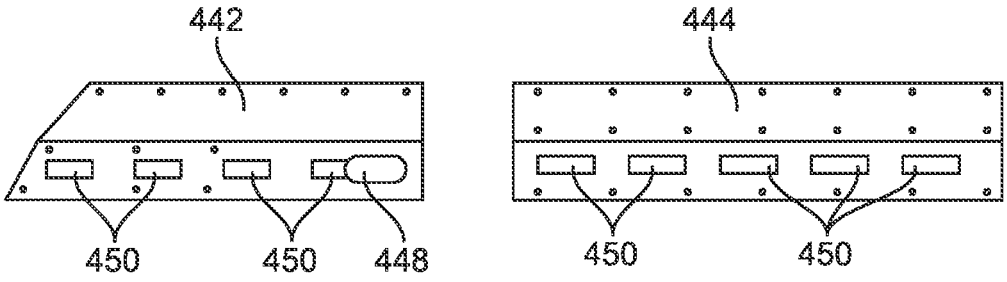

Turning now to FIGS. 3A and 3B, a front view is presented of alternative embodiments for first fender panel 422, 442 and second fender panel 424, 444. More specifically, FIG. 3A shows first fender panel 422 and second fender panel 424, which are both sheet material that has been formed to fit the desire needs. An overlapping lip 426 is formed on second fender panel 424, so the two panels can be overlapped when attached to a refuse truck. In this embodiment, an access opening 428 is located on a lower portion of first panel 422 which will allow an installer to access other components such as wiring for lights or final assembly points. It is contemplated that this opening 428 is covered after final assembly by a plug or cover plate. In a similar manner, FIG. 3B shows another embodiment, with first fender panel 442 and second fender panel 444 being configured to meet the needs of refuse vehicle 10, while also adding additional features. More specifically, a plurality of warning lights 450 are included as part of first fender panel 442 and second fender panel 444. This embodiment illustrates that other features can be incorporated into the fender panels as needed.

Figure 4:
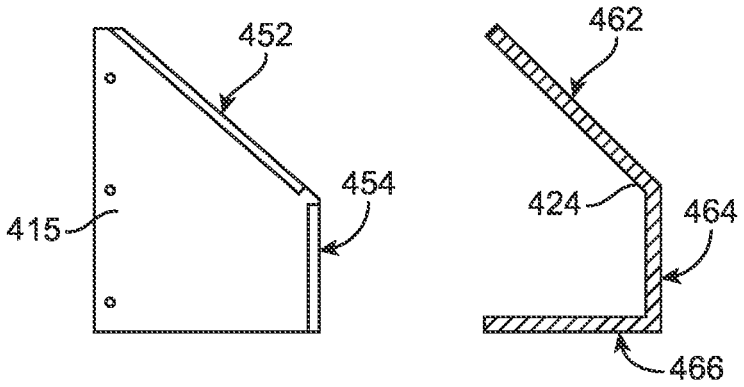
FIG. 4 is a cross-sectional exploded view of the bolt-on fender and a mounting bracket.

In a similar manner, FIG. 4 shows a cross-sectional exploded view of removable second fender panel 424, along with a side view of fifth bracket 415. As illustrated, fifth bracket 415 is configured to have a sloped supporting surface 452, and an adjacent vertical supporting surface 454. It will be understood that each of these supporting surfaces (452, 454) will have attachment holes to accommodate connection of the related removable panel 424. Further, fender panel 424 has a related sloped surface 462 and a related vertical surface 464. The sloped surfaces help to avoid build-up of material, dirt and related residue on the side of main collection body 40. The angle of the sloped surface 462 can vary depending on the situation and desires of the collection operator. That said, it is desirable to have sufficient slope so that water and related liquids will easily be deflected away from the sidewall of main collection body 40. In one embodiment, the angle of the sloped surface with respect or horizontal is between 20° and 70°. Removable panel 424 also has a bottom surface 466 which is configured to surround a bottom side of bracket 415 and to provide additional attachment features.

Figure 5:
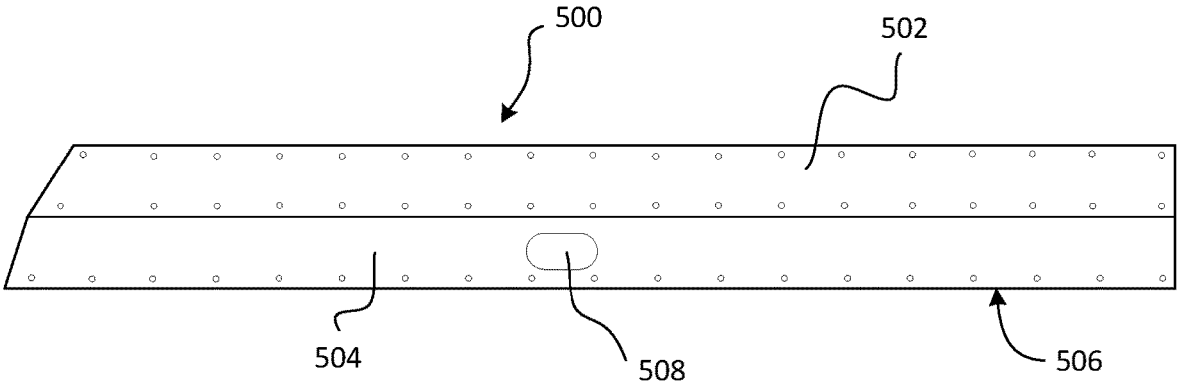
FIG. 5 is a side view of another alternative embodiment of the bolt-on fenders.

Turning now to FIG. 5, an embodiment of a single piece removable fender panel 500 is shown. As will be recognized, single piece removable fender panel 500 is formed from a continuous sheet of panel material, thus avoiding the need for an overlapping center seam. In this embodiment, single piece removable fender panel 500 has the same general cross-sectional configuration as the previous fender panel members (and as illustrated in FIG. 4 above), including a sloped surface 502, a generally vertical surface 504 and a bottom surface 506. Single piece fender panel 500 also includes an access opening 508 configured to allow access to wiring or other components/systems located at those portions of collection body 40. Although bottom surface 506 is not visible in FIG. 5, this portion of single piece fender panel 500 will be configured similar to bottom surface 466 shown in FIG. 4. Based upon this configuration, single piece fender panel 500 will be attachable to multiple fender brackets (e.g. first bracket 411, second bracket 412, third bracket 413, fourth bracket 414, fifth bracket 415 and sixth bracket 416) in a manner similar to the previously discussed fender brackets.

In each of the embodiments discussed above, removable fender panels 422, 424, 442 and 444 are removably coupled to main collection body 40 in any number of ways, including bolting, snapping or screwing. Other alternative connection methods could be used, so long as these are removable.

It will be recognized that the use of removable fender panels will also provide further flexibility in the manufacturing of the refuse collection body. More specifically, these could provide space on the outside of main refuse collection 40 to run wiring and/or hydraulic lines. Since the related fender panels are removable, these components could be easily serviced by simply removing the related panel. Naturally, these spaces could be used for other purposes, as they provide an enclosed space running the length of main collection body 40.

To provide options for an operator of refuse truck fleets, the removable panels discussed above (422, 424, 442, 444, 500) can be fabricated from a variety of materials, such as steel, stainless steel, aluminum, and any number of non-metallic materials such as carbon fiber materials, polyethylene, polymers, elastomers, vinyls, textiles, organic and non-organic compounds, and various composites. Clearly, a material that is rugged and durable will be greatly desired so as to withstand the harsh conditions encountered. The removable panels can further be created by several processes, including molding, stamping, extruding, and other forming techniques.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A refuse collection vehicle, comprising:

a frame assembly;

a main collection body mounted to the frame assembly, the main collection body having a plurality of sidewalls defining a main collection chamber;

a collection system coupled to the main collection body comprising a transfer device to move refuse to the main collection chamber; and a fender assembly coupled to an outer portion of the main collection body, the fender assembly comprising a plurality of support brackets and an elongate removable fender panel having a length, wherein the plurality of support brackets are affixed to an outer side of one of the plurality of sidewalls of the main collection body at a bottom portion thereof, and wherein the elongate removable fender panel comprises a sloped surface with a continuous upper edge, and wherein the continuous upper edge of the sloped surface is positioned closely adjacent the outer side of the sidewall of the main collection body along the length of the elongate removable fender panel when coupled to the plurality of support brackets, and wherein the sloped surface is oriented at a first predetermined angle with respect to horizontal so as to help deflect water, liquids, dirt and/or debris away from the outer side of the sidewall of the main collection body, the elongate removable fender panel further having at least one vertical surface adjoining and adjacent to the sloped surface which, when coupled to the plurality of support brackets, is situated in a substantially vertical orientation.

2. The refuse collection vehicle of claim 1 wherein the plurality of support brackets have a sloped support surface configured to be juxtaposed with the sloped surface of the elongate removable fender panel.

3. The refuse collection vehicle of claim 2 wherein the elongate removable fender panel is formed of stainless steel.

4. The refuse collection vehicle of claim 2 wherein the elongate removable fender panel is formed of a non-metallic material.

5. The refuse collection vehicle of claim 4 wherein the non-metallic material is selected from a group consisting of polymers, elastomers, vinyls, textiles, organic and non-organic compounds, and composites.

6. The refuse collection vehicle of claim 1 wherein the first predetermined angle is greater than 20° and less than 70°.

7. The refuse collection vehicle of claim 1 further comprising a second fender assembly coupled to the main collection body at a second side location thereof, the second fender assembly comprising a second plurality of support brackets and a second elongate removable fender panel, wherein the second plurality of support brackets are affixed to the main collection body at an outer side of a second one of the plurality of outer sidewalls at a lower portion thereof, the second elongate removable fender panel having a sloped surface which, when coupled to the second plurality of support brackets, is situated at a second predetermined angle with respect to horizontal, the sloped surface of the second elongate removable fender panel having an upper edge which is positioned closely adjacent the outer side of the second sidewall so as to help deflect water, liquids, dirt and/or debris away from the outer side of the second sidewall of the main collection body, the second elongate removable fender panel further having a vertical surface adjoining and adjacent to the sloped surface which, when coupled to the second plurality of support brackets, is situated in a substantially vertical orientation.

8. The refuse collection vehicle of claim 7 wherein the elongate removable fender panel and the second elongate removable fender panel each include a first panel segment and a second segment configured to be coupled to the main collection body in an overlapped configuration so as to span a predetermined length of the main collection body.

9. The refuse collection vehicle of claim 7 wherein the elongate removable panel and the second elongate removable panel each further comprise a bottom surface adjoining and below the vertical surface which is substantially horizontal when removably attached to the bracket, and wherein the elongate removable panel and the second elongate removable are configured to surround the bracket.

10. The refuse collection vehicle of claim 9 wherein the elongate removable panel and the second elongate removable panel create a pair of substantially enclosed spaces when coupled to the main collection body, the pair of substantially enclosed spaces defined by the elongate removable panel, the second elongate removable panel and the sidewalls, and configured to enclose wiring, hoses or other connections.

11. The refuse collection vehicle of claim 7 wherein the first predetermined angle and the second predetermined angle are equal and are greater than 20° and less than 70°.

12. The refuse collection vehicle of claim 1 wherein the elongate removable panel further comprises a bottom surface adjoining and below the vertical surface which is substantially horizontal when removably attached to the bracket, and wherein the removable panel is configured to surround the bracket.

13. The refuse collection vehicle of claim 12 wherein the removable panel creates a substantially enclosed space when coupled to the main collection body, the substantially enclosed space defined by the removable panel and the sidewall, and configured to enclose wiring, hoses or other connections.

14. The refuse collection vehicle of claim 1 wherein the removable panel creates a substantially enclosed space when coupled to the main collection body, the substantially enclosed space defined by the removable panel and the sidewall, and configured to enclose wiring, hoses or other connections.

15. A refuse collection vehicle comprising:

a vehicle frame;

a main collection body supported by the vehicle frame, the main collection body having a collection mechanism, a pair of sidewalls and a front wall structure, wherein the pair of sidewalls and front wall structure form a collection housing for receiving refuse from the collection mechanism during refuse collection operations, wherein each sidewall has a top edge and a bottom edge, and each sidewall is situated on opposite sides of the refuse collection vehicle;

a plurality of fender brackets affixed to the main collection body at the bottom edge of each of the pair of sidewalls, wherein each of the plurality of fender brackets have a sloped supporting surface and a vertical supporting surface positioned below the sloped supporting surface, with the vertical supporting surface being oriented in a near vertical orientation when the refuse collection vehicle is operating, wherein the sloped supporting surface is oriented at a predetermined angle with respect to horizontal;

a pair of elongate removable fender panels, each configured to be removably coupled to a related subset of the plurality of fender brackets, wherein each elongate removable fender panel comprises a sloped panel surface, an adjoining vertical panel surface and an adjoining bottom surface, wherein the sloped panel surface of each of the pair of fender panels is configured to be closely positioned upon the sloped supporting surface of the related subset of the plurality of fender brackets and positioned such that a top edge of the sloped panel surface is closely adjacent to a corresponding one of the pair of sidewalls of the main collection body along an entire length of the top edge so as to help deflect water, liquids, dirt and/or debris away from the pair of sidewalls of the main collection body, and wherein the vertical panel surface of each elongate removable fender panel is configured to be positioned adjacent the vertical surface of the related subset of the plurality of fender brackets, and wherein the bottom surface of each elongate removable fender panel is configured to be positioned below the related subset of the plurality of fender brackets; and a plurality of connectors removably coupling the removable fender panels to the plurality of fender brackets.

16. The refuse collection vehicle of claim 15 wherein the predetermined angle is greater than 20° and less than 70°.

17. The refuse collection vehicle of claim 15 wherein the pair of elongate removable fender panels are formed of a non-metallic material.

18. The refuse collection vehicle of claim 17 wherein the non-metallic material is selected from a group consisting of polymers, elastomers, vinyls, textiles, organic and non-organic compounds, and composites.

19. The refuse collection vehicle of claim 15 wherein each of the pair of elongate removable fender panels are formed of a plurality of fender panel segments and wherein the plurality of panel segments have overlapping joints therebetween.

20. The refuse collection vehicle of claim 15 wherein the pair of elongate removable panels are formed of stainless steel.

21. The refuse collection vehicle of claim 15 wherein the pair of elongate removable panels creates a pair of substantially enclosed spaces when coupled to the main collection body, the pair of substantially enclosed spaces defined by the removable panel and the sidewalls, and configured to enclose wiring, hoses or other connections.

* * * * *